United States Patent [19]

Mathieson

[11] 4,227,497

[45] Oct. 14, 1980

[54] FUEL METERING AND TRANSFER CONTROL SYSTEM

[76] Inventor: Roy W. Mathieson, 6801 11th Ave., W., Bradenton, Fla. 33505

[21] Appl. No.: 45,212

[22] Filed: Jun. 4, 1979

[51] Int. Cl.[3] ..... F02M 13/08

[52] U.S. Cl. ..... 123/525; 123/575; 261/16

[58] Field of Search ..... 123/121, 127, 27 GE, 123/3; 261/16

[56] References Cited

U.S. PATENT DOCUMENTS

| | | | |
|---|---|---|---|
| 2,050,978 | 8/1936 | Thatcher | 123/127 |
| 3,308,794 | 3/1967 | Bailey | 123/127 |
| 3,421,483 | 1/1969 | Fox | 123/127 |
| 3,556,066 | 1/1971 | Muirhead | 123/127 |
| 3,805,756 | 4/1974 | Madariaga | 123/127 |
| 4,019,477 | 4/1977 | Overton | 123/127 |
| 4,056,087 | 11/1977 | Boyce | 123/127 |
| 4,068,639 | 1/1978 | Cook | 123/127 |
| 4,085,720 | 4/1978 | Etoh | 123/127 |
| 4,088,102 | 5/1978 | Kato | 123/127 |
| 4,090,484 | 5/1978 | Itoh | 123/127 |
| 4,094,288 | 6/1978 | Davis | 123/127 |
| 4,129,620 | 12/1978 | Etoh | 123/127 |

*Primary Examiner*—Ronald H. Lazarus

[57] ABSTRACT

An auxiliary fuel metering and transfer control system for an internal combustion engine. The system consists essentially of a pressure vessel for storage of propane, methane, natural gas or a similar gaseous fuel, a pressure regulator for maintaining constant gaseous fuel pressure during operation of the system, a solenoid valve and a magnetic reset safety switch, a metering valve, a transfer valve and an auxiliary fuel nozzle positioned in the Venturi of the carburetor on the engine using the system. The metering valve operates in response to changes in the intake manifold vacuum of the engine and changes in the air velocity in the carburetor of the engine. The transfer valve operates in response to movement of the throttle linkage on the carburetor of the engine. During operation of the engine, the system is substituted for both the idle circuit or system and the acceleration circuit or system of the carburetor.

6 Claims, 4 Drawing Figures

FUEL METERING AND TRANSFER CONTROL SYSTEM

BACKGROUND AND SUMMARY OF INVENTION

This invention relates to an auxiliary fuel metering and transfer control system for an internal combustion engine.

Since their initial development in the late 17th Century and the early 18th Century, internal combustion engines have become a major means by which man amplifies his capability to do work. Internal combustion engines are used for almost every conceivable task requiring a prime mover, ranging from generation of electric power to moving people, goods and materials. Probably the most important application of the internal combustion engine in the United States is the use of gasoline engines as prime movers for automotive vehicles, such as passenger cars, buses, trucks, motorcycles, tractors, airplanes, motorboats and earthmovers.

It is well known that the gasoline which is consumed in gasoline engines consists essentially of volatile flammable liquid hydrocarbons which are derived from crude petroleum. It is also well known that the United States is heavily dependent on the supplier nations of the Middle Eastern Region for crude petroleum. In recent years, the supplier nations have taken advantage of this dependency to obtain substantial increases in the prices for crude petroleum sold to the United States. Furthermore, the political stability of many of the supplier nations is uncertain, and therefore, it is not known whether crude petroleum will be available in the future from several of the supplier nations at any price. For these reasons, it is desirable for the United States to reduce its dependency on the supplier nations for crude petroleum. If the United States is to substantially reduce its dependency on the supplier nations, it must either locate and develop new sources of crude petroleum or reduce its consumption of crude petroleum, or both. It is generally believed that reducing consumption of crude petroleum is the more promising of the two alternatives for the United States in the near future. And, of course, reducing consumption of crude petroleum is an important long-range objective for the United States.

Because of the widespread use of gasoline engines in the United States, it is possible for the United States to achieve substantial reductions in its total consumption of crude petroleum by reducing the total amount of gasoline consumed by gasoline engines. Various means, including means for burning fuels other than gasoline in gasoline engines, have been proposed for reducing the total amount of gasoline consumed by gasoline engines. Some of the proposed means include fuel system modifications which enable substitute liquid or gaseous fuels to be burned in gasoline engines. Other of the proposed means include fuel system modifications which enable both gasoline and an auxiliary liquid or gaseous fuel to be burned in gasoline engines.

Various liquid or gaseous fuels, including alcohol, methane, propane and natural gas, have been proposed as either substitute fuels or auxiliary fuels, or both, for burning in gasoline engines. These fuels are available from various sources in the United States. Equipment for modifying the fuel system of gasoline engines to enable such engines to burn either propane or natural gas as a substitute fuel is commercially available. The equipment which is commercially available has proved to be satisfactory for its intended purpose. Some of the equipment which is commercially available is "duel-fuel" equipment. Such equipment provides a means whereby the operator of an automotive vehicle having the equipment installed can switch from gasoline to propane or natural gas or from propane or natural gas to gasoline for burning in the gasoline engine of the vehicle.

Whether of the single fuel or dual-fuel type, the equipment which is commercially available merely provides a means for substituting propane or natural gas for gasoline. Under certain operating conditions, either propane or natural gas burns more efficiently than gasoline in gasoline engines. Under other operating conditions, gasoline burns more efficiently than either propane or natural gas in gasoline engines. Accordingly, it is desirable to have means for burning both gasoline and propane or natural gas at the appropriate times and under the appropriate conditions in a gasoline engine such that the combustion efficiency of both the gasoline and the propane or natural gas is increased.

The present invention provides a system which enables a gasoline engine to burn both gasoline and a gaseous auxiliary fuel, such as propane, methane, natural gas or a similar gaseous fuel. The principle object of the present invention is to provide a system which substantially reduces the total gasoline consumption of a gasoline engine using the system while causing that engine to consume only small quantities of the gaseous auxiliary fuel. To achieve that objective, the gaseous auxiliary fuel is injected directly into the Venturi of a conventional carburetor at appropriate times and under appropriate conditions during operation of the gasoline engine. Thus, combustion efficiency is increased for both the gasoline and the gaseous auxiliary fuel.

A further object of the present invention is to improve the acceleration and other performance characteristics of a gasoline engine using the system of the present invention. Still another object of the present invention is to provide a system which reduces the total amounts of unburned hydrocarbons and other harmful pollutants emitted from a gasoline engine using the system.

Yet another object of the present invention is to reduce the total amounts of sludge and other deposits on the interior surfaces of a gasoline engine using the system. Reduction of such deposits reduces wear on the interior surfaces of the engine, and thereby, increases the useful life of the engine while reducing maintenance expenses for the engine during that useful life.

Still another object of the present invention is to increase the load capacity and horsepower output of a gasoline engine using the system. Yet another object of the present invention is to increase the range of an automotive vehicle powered by a gasoline engine using the system and the operating time of a stationary gasoline engine using the system.

A further object of the present invention is to provide a system which can be used with a gasoline engine without major modifications to that engine. Yet another object of the present invention is to provide a system which can be installed in a conventional automotive vehicle without reducing the capacity of that vehicle to carry people, goods or materials. Still another object of the present invention is to provide a system which can be installed for use with a gasoline engine by persons having minimal training and experience relating to gasoline engines.

The auxiliary fuel metering and transfer control system of the present invention is comprised of a pressure vessel for storage of gaseous fuel, a conventional pressure regulator, a pressure gauge, a solenoid valve, an auxiliary fuel metering and transfer control assembly, an auxiliary fuel nozzle and interconnecting gaseous fuel lines. Electric energy necessary for operation of the solenoid valve is obtained from a conventional source, such as the battery of an automotive vehicle. A magnetic reset safety switch and a protective fuse are included in the electrical circuit. The auxiliary fuel metering and transfer control assembly is comprised of a metering valve and a transfer valve. The metering valve is operatively responsive to changes in both the intake manifold vacuum for the gasoline engine using the system and the air velocity in the throat of the carburetor of that gasoline engine. The transfer valve is operatively connected to the throttle linkage on that carburetor.

In accordance with the recited objects of the present invention, the components which are disclosed are for a system which is suitable for use with gasoline engines. Nevertheless, the auxiliary fuel metering and transfer system of the present invention can be used with other internal combustion engines, including diesel engines, if appropriate component modifications are made.

These and many other objects, advantages and features of the present invention will be apparent from the following brief description of drawings, description of the preferred embodiment and the appended claims.

DESCRIPTION OF THE PREFERRED EMBODIMENT

The preferred embodiment of the auxiliary fuel metering and transfer control system of the present invention is illustrated in FIGS. 1–4.

In the preferred embodiment, pressure vessel 10 is a conventional pressure vessel or tank for storage of a gaseous auxiliary fuel, such as propane, methane, natural gas or a similar gaseous fuel. Pressure vessel 10 is mounted either in the trunk compartment or between the frame rails of a conventional passenger car. Other suitable locations can be used when the system is installed for use on other types of automotive vehicles. Pressure vessel 10 is equipped with a conventional shut-off valve, not illustrated in FIG. 1. Pressure regulator 12 and pressure gauge 14 are fitted on gas outlet 16 of pressure vessel 10. Pressure regulator 12 is adjusted and set to maintain a constant gas pressure during operation of the system. The volume displacement of the particular gasoline engine with which the system is used determines the particular gas pressure which is maintained during operation of the system.

Figure 1:
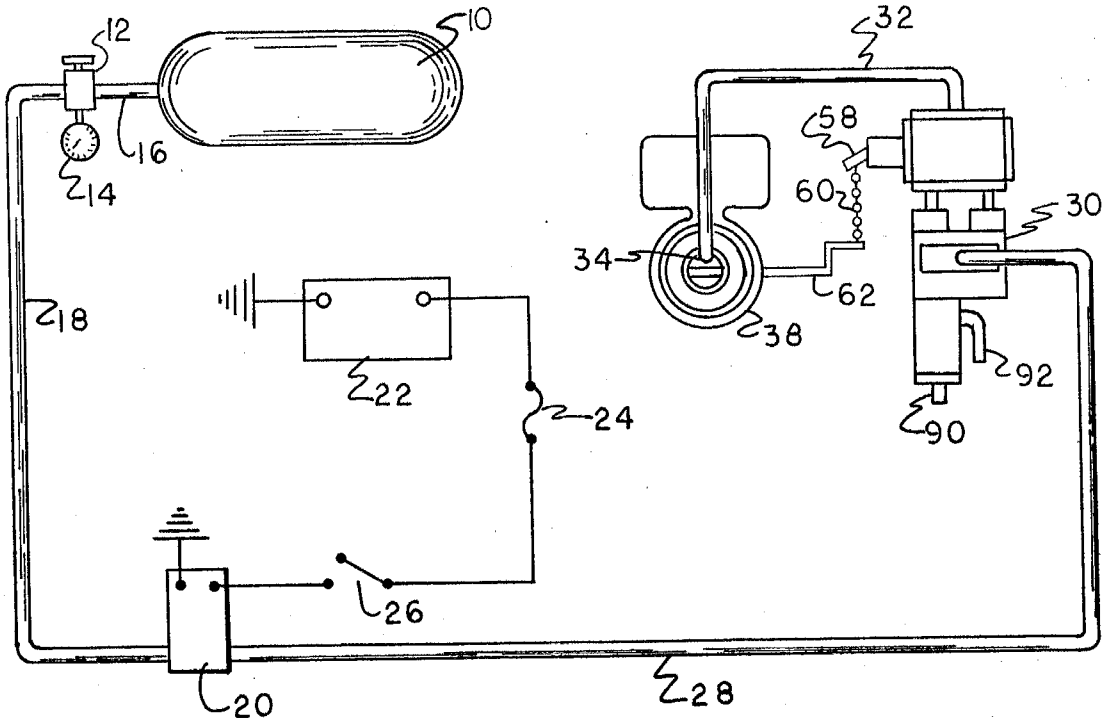
FIG. 1 is a schematic view of the system of the present invention.

In the preferred embodiment, fuel line 18 connects pressure regulator 12 and solenoid valve 20 located in the engine compartment of the automotive vehicle. Solenoid valve 20 is provided to assure that the flow of gaseous auxiliary fuel from pressure vessel 10 to auxiliary fuel metering and transfer control assembly 30 is stopped if the gasoline engine with which the system is used ceases to operate. Accordingly, electric energy from the electrical circuit of the automotive vehicle is used to open solenoid valve 20 and maintain it in the open mode during operation of the gasoline engine. If the flow of electric energy is interrupted, solenoid valve 20 closes and remains in the closed mode to prevent the flow of gaseous auxiliary fuel to fuel metering and transfer control assembly 30. FIG. 1 illustrates a portion of a typical automotive vehicle electrical circuit, including battery 22, fuse 24 and safety switch 26. Fuse 24 is provided to protect solenoid valve 20 from power surges.

Safety switch 26 is mounted in the passenger compartment of the automotive vehicle within convenient reach of the operator of the vehicle. Safety switch 26 is a conventional magnetic reset switch which must be activated by the operator each time it is desired to start the gasoline engine with which the system is used. Safety switch 26 is provided with an indicator light which is lighted when the system is operating. If the flow of electric energy through the electrical circuit is interrupted, safety switch 26 is opened to assure that solenoid valve 20 remains closed.

Figure 2:
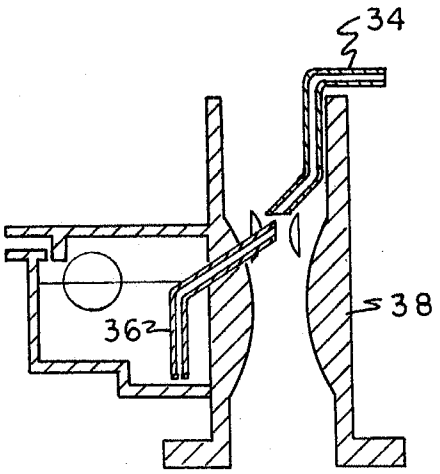
FIG. 2 is a sectional view of a simple carburetor illustrating the placement of an auxiliary fuel nozzle in the Venturi of the carburetor.

Gas fuel line 28 connects solenoid valve 20 and auxiliary fuel metering and transfer control assembly 30. Gas fuel line 32 connects auxiliary fuel metering and transfer control assembly 30 and auxiliary fuel nozzle 34. FIG. 2 illustrates the placement of auxiliary fuel nozzle 34 immediately over main nozzle 36 in the Venturi of carburetor 38. As illustrated, carburetor 38 is a simple single-throat carburetor. If it is desirable to use the system with a gasoline engine having a more complex carburetor with a plurality of throats, an auxiliary fuel nozzle is provided for each throat.

Auxiliary fuel metering and transfer control assembly 30 is comprised of two major components, namely, transfer valve 40 and metering valve 42. Transfer valve 40 can be purchased commercially as a MAC 1800 Series, ¼", four-way, five-ported, two-position valve having a dual inlet single exhaust spool and a whisker operator. MAC is a Federally registered trademark of MAC Valves, Inc., 30569 Beck Road, Wixon, Michigan 48096, the manufacturer. To use the MAC valve as transfer valve 40, the inlet port of the valve is blocked, the normal flow direction is reversed and appropriate adapters are provided. In particular, adapter 44 is provided to partially cover exhaust port 46 and exhaust port 48. In addition, adapter 44 provides a means for connecting transfer valve 40 and metering valve 42. Adapter 50 is provided to combine the flow of gaseous auxiliary fuel from cylinder port 52 and cylinder port 54 for transmission through gas feed line 32 to auxiliary fuel nozzle 34. It can be readily seen that both exhaust port 46 and exhaust port 48 are used as inlet ports in the present invention. In like manner, both cylinder port 52 and cylinder port 54 are used as outlet ports.

Figure 3:
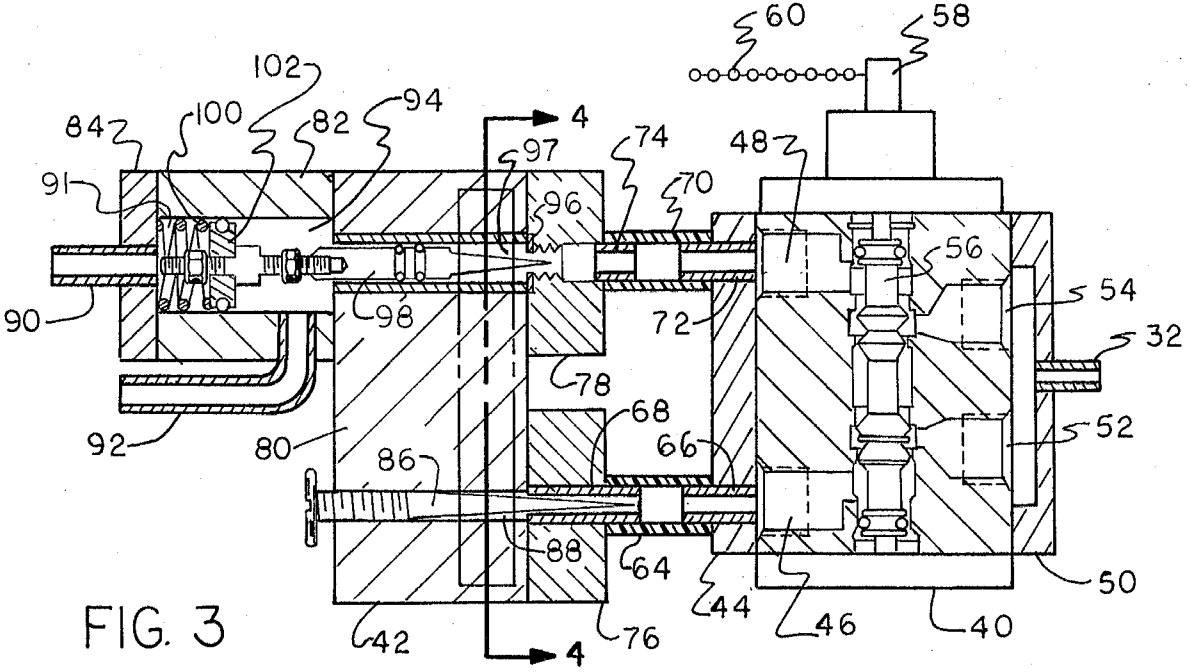
FIG. 3 is a partial sectional view of the auxiliary fuel metering and transfer control assembly of the present invention.
Figure 4:
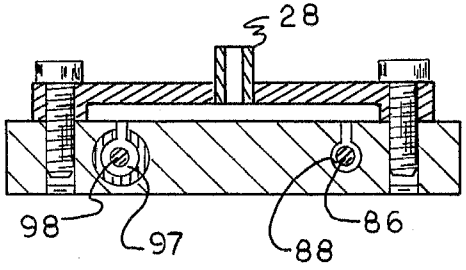
FIG. 4 is a sectional view along lines 4—4 in FIG. 3.

In transfer valve 40, dual action spool 56 is operatively connected to valve operator 58. A conventional coil spring not illustrated in FIG. 3 is used to provide the force necessary for movement of dual action spool 56 during operation of transfer valve 40. Control chain 60 is provided to operatively connect valve operator 58 of transfer valve 40 and throttle linkage 62 for carburetor 38. It will be readily seen by those skilled in the art that other conventional means for operatively connecting valve operator 58 and throttle linkage 62 could be substituted for control chain 60.

Conventional connecting means are used to connect transfer valve 40 and metering valve 42 for flow of gaseous auxiliary fuel from metering valve 42 to transfer valve 40. FIG. 3 illustrates the use of flexible hose 64 joining connector tube 66 in adapter 44 and connector tube 68 in metering valve 42. In like manner, FIG. 3 illustrates the use of flexible hose 70 joining connector tube 72 in adapter 44 and connector tube 74 in metering valve 42.

As illustrated in FIG. 3, metering valve 42 is comprised of five major components assembled to create a single valve body. These components are valve cylinder head 76, valve cylinder head 78, main valve body 80, vacuum chamber body 82 and vacuum chamber closure plate 84. These components are assembled with conventional machine screws, not illustrated in FIG. 3. Conventional O-rings, not illustrated in FIG. 3, are provided for gas-tight seals between these components. This particular combination of components was selected for convenience of fabrication of the prototype valve body. It can be readily seen that other components can be combined to form a valve body having the same interior vacuum chambers and gaseous auxiliary fuel passageways. In particular, two components, a main valve body and a closure plate, can be substituted for the five components illustrated in FIG. 3 without altering the interior configuration of metering valve 42. In like manner, those skilled in the art will recognize that transfer valve 40 and metering valve 42 can be combined as a single unit with the interior configuration of the separate units illustrated in FIG. 3 for manufacture of auxiliary fuel metering and transfer control assembly 30.

In metering valve 42, idle adjustment needle 86 is provided with conventional screw threads on the cylindrical portion thereof which mate with conventional screw threads provided on a portion of the surface of gas passageway 88. Vacuum line 90 connects vacuum chamber 91 to either a pre-existing port through the wall of carburetor 38 or a port drilled through the wall of carburetor 38 at a location which does not interfere with the operation of existing carburetor circuits or systems. Depending on the particular carburetor used with the gasoline engine, this port can be located either above or below the throttle valve of carburetor 38. Vacuum line 92 connects vacuum chamber 94 to either a pre-existing port through the wall of the intake manifold or to an appropriate connector located in the main vacuum line from the intake manifold of the gasoline engine. Valve seat 96 is provided in gas passageway 97 for cooperation with metering needle 98. Coil spring 100 is provided in vacuum chamber 91 to maintain a constant force on piston 102, and thereby, to bias metering needle 98 in the closed mode. Piston 102 is provided with a conventional o-ring to maintain a gas-tight seal between vacuum chamber 91 and vacuum chamber 94. Metering needle 98 is provided with conventional o-rings to maintain a gas-tight seal between vacuum chamber 94 and gas passageway 97.

Having described the physical characteristics of the auxiliary fuel metering and transfer control system of the present invention, its operation will now be described. First, the idle adjustment needles in carburetor 38 are seated to prevent gasoline from entering the throat of carburetor 38 when the gasoline engine using the system is being operated under idle conditions. Next, the acceleration circuit or system of carburetor 38 is appropriately adjusted to substantially reduce the amount of gasoline which enters the throat of carburetor 38 by means of the acceleration circuit or system of that carburetor when the gasoline engine using the system of the present invention is being operated under acceleration conditions. In general, it is desired to have only approximately five percent of the gasoline which normally enters the throat of the particular carburetor by means of the acceleration circuit or system of that carburetor under acceleration conditions enter the throat of the carburetor under such conditions when the gasoline engine is being operated with the system of the present invention. It can be readily seen that these adjustments result in a substitution of the auxiliary fuel metering and transfer control system for both the idle circuit or system and the acceleration circuit or system of carburetor 38.

The shut-off valve on pressure vessel 10 is opened to allow the gaseous auxiliary fuel to flow through gas outlet 16 to pressure regulator 12. Safety switch 26 is reset and the gasoline engine is started. Electric energy from the electrical circuit causes solenoid valve 20 to open and maintains solenoid valve 20 in an open mode. Gaseous auxiliary fuel from fuel line 18 flows through solenoid valve 20 and enters fuel line 28. Gaseous auxiliary fuel flows through fuel line 28 to fuel metering and transfer control assembly 30.

Under idle conditions, gaseous auxiliary fuel enters metering valve 42 of fuel metering and transfer control assembly 30 and flows through gas passageway 88, connector tube 68, flexible hose 64 and connector tube 66 before entering transfer valve 40. It will be recalled that transfer valve 40 as illustrated in FIG. 3 is a conventional MAC Valve operated with its normal flow direction reversed. Accordingly, under idle conditions, gaseous auxiliary fuel flowing from metering valve 42 enters transfer valve 40 through exhaust port 46. Under idle conditions, dual action spool 56 of transfer valve 40 is positioned to allow gaseous auxiliary fuel entering transfer valve 40 through exhaust port 46 to flow through the valve body and depart transfer valve 40 through cylinder port 52. When dual action spool 56 is positioned in this location, no gaseous auxiliary fuel can enter transfer valve 40 through exhaust port 48 and depart transfer valve 40 through cylinder port 54. Nevertheless, the force of coil spring 100 acting on piston 102 combined with the vacuum in vacuum chamber 94 maintains metering needle 98 in its closed mode to prevent flow of gaseous auxiliary fuel through gas passageway 97. Under idle conditions, the pressure at the intake manifold is maintained at its maximum negative value, and therefore, vacuum chamber 94 experiences its maximum vacuum condition. No vacuum is experienced in vacuum chamber 91. Under idle conditions, gaseous auxiliary fuel departs transfer valve 40 through cylinder port 52, flows through the passageway in adapter 50, enters fuel line 32 and flows to auxiliary fuel nozzle 34 for injection into the Venturi of carburetor 38.

When the gasoline engine is accelerated, throttle linkage 62 on carburetor 38 causes control chain 60 to move valve operator 58 on transfer valve 40. Referring to FIG. 3, movement of valve operator 58 by control chain 60 causes dual action spool 56 in transfer valve 40 to move upward. When dual action spool 56 is positioned in this location, no gaseous auxiliary fuel entering transfer valve 40 through exhaust port 46 is allowed to depart transfer valve 40 through cylinder port 52. But, gaseous auxiliary fuel can enter transfer valve 40 through exhaust port 48 and depart transfer valve 40 through cylinder port 54. Under acceleration conditions, the negative pressure at the intake manifold is zero, and therefore, no vacuum exists in vacuum chamber 94. At the same time, the increased air velocity through the throat of carburetor 38 causes a vacuum in vacuum chamber 91 which is sufficient to overcome the force of coil spring 100 and pull metering needle 98 open. This permits gaseous auxiliary fuel entering metering valve 42 through fuel line 28 to flow through gas passageway 97, connector tube 74, flexible hose 70 and connector tube 72 into transfer valve 40 through exhaust port 48 and out of transfer valve 40 through cylinder port 54. Gaseous auxiliary fuel departing transfer valve 40 through cylinder port 54 flows through the passageway in adapter 50, enters fuel line 32 and flows to auxiliary fuel nozzle 34 for injection into the Venturi of carburetor 38.

When ideal cruise conditions are achieved, the vacuum in vacuum chamber 94 and the force of the coil spring on piston 102 will balance the vacuum in vacuum chamber 91 and maintain metering needle 98 in its closed mode. When the gasoline engine encounters an increased load, the pressure in vacuum chamber 94 will increase in response to the change in the vacuum level of the intake manifold. The air velocity in the throat of carburetor 38 will remain constant, and therefore, the pressure in vacuum chamber 91 will remain constant. Thus, coil spring 100 will be compressed and metering needle 98 will open to allow gaseous auxiliary fuel to flow through gas passageway 97. For this reason, it is not necessary for the operator of the automotive vehicle to cause the throttle valve of carburetor 38 to open further for the gasoline engine to respond to increased load conditions. When the load decreases, the pressure in vacuum chamber 94 decreases and metering needle 98 closes.

While the present invention has been disclosed in connection with the preferred embodiment thereof, it should be understood that there may be other embodiments which fall within the spirit and scope of the invention as defined by the following claims:

I claim:

1. An auxiliary fuel metering and transfer control system for an internal combustion engine, comprising:

(a) a pressure vessel, having a shut-off valve and a gas outlet, for storage of propane, methane, natural gas or a similar gaseous fuel;

(b) a pressure regulator, fitted on said gas outlet, which maintains a constant gaseous fuel pressure during operation of the system;

(c) a metering valve which operates in response to changes in the intake manifold vacuum of the engine and changes in the air velocity in the carburetor of the engine;

(d) a transfer valve which operates in response to movement of the throttle linkage on the carburetor of the engine;

(e) an auxiliary fuel nozzle positioned immediately above the outlet of the main nozzle in the center of the Venturi of the carburetor;

(f) a fuel line for flow of gaseous fuel from said gas outlet of said pressure vessel into said metering valve;

(g) means for flow of gaseous fuel from said metering valve into said transfer valve; and (h) a fuel line for flow of gaseous fuel from said transfer valve into said auxiliary fuel nozzle for injection into the Venturi of the carburetor.

2. An auxiliary fuel metering and transfer control system as recited in claim 1, further comprising a solenoid valve located in said fuel line for flow of gaseous fuel from said gas outlet of said pressure vessel into said metering valve and operated by electric energy from the electrical circuit of an automotive vehicle using the system.

3. An auxiliary fuel metering and transfer control system as recited in claim 2, further comprising a magnetic reset safety switch in said electrical circuit.

4. An auxilary fuel metering and transfer control system as recited in claim 1, wherein said metering valve is comprised of a valve body having a first vacuum chamber and a vacuum line connecting said first vacuum chamber and a port through the wall of the carburetor, a second vacuum chamber and a vacuum line connecting said second vacuum chamber and a port through the wall of the intake manifold, a first gas passageway for flow of gaseous fuel entering said metering valve and a second gas passageway for flow of gaseous fuel entering said metering valve; a piston movably positioned to separate said first vacuum chamber and said second vacuum chamber; a metering needle rigidly attached to said piston and movably positioned in said first gas passageway; a spring positioned in said first vacuum chamber to apply force on said piston and bias said metering needle in a closed mode; an idle adjustment needle positioned in said second gas passageway; means for flow of gaseous fuel from said first gas passageway into said transfer valve; and means for flow of gaseous fuel from said second gas passageway into said transfer valve.

5. An auxiliary fuel metering and transfer control system as recited in claim 1, wherein said transfer valve is comprised of a valve body having a first inlet port for receipt of gaseous fuel from said first gas passageway of said metering valve, a second inlet port for receipt of gaseous fuel from said second gas passageway of said metering valve, a first outlet port for discharge of gaseous fuel entering said transfer valve through said first inlet port and a second outlet port for discharge of gaseous fuel entering said transfer valve through said second inlet port; a dual action spool movably positioned in said valve body, said dual action spool having a first control position which prevents gaseous fuel from departing said transfer valve through said first outlet port while allowing gaseous fuel to depart said transfer valve through said second outlet port and a second control position which prevents gaseous fuel from departing said transfer valve through said first outlet port while allowing gaseous fuel to depart said transfer valve through said first outlet port; a valve operator operatively connected to said dual action spool; means for connecting said valve operator to the throttle linkage on the carburetor; and means for connecting said first outlet port and said second outlet port to said fuel line for flow of gaseous fuel from said transfer valve into said auxiliary fuel nozzle.

6. An auxiliary fuel metering and transfer control system for an internal combustion engine, comprising:

(a) a pressure vessel, having a shut-off valve and a gas outlet, for storage of propane, methane, natural gas or a similar gaseous fuel;

(b) a pressure regulator, fitted on said gas outlet, which maintains a constant gaseous fuel pressure during operation of the system;

(c) a metering valve comprised of a valve body having a first vacuum chamber and a vacuum line connecting said first vacuum chamber and a port through the wall of the carburetor of the engine, a second vacuum chamber and a vacuum line connecting said second vacuum chamber and a port through the wall of the intake manifold of the engine, a first gas passageway for flow of gaseous fuel entering said metering valve and a second gas passageway for flow of gaseous fuel entering said metering valve; a piston movably positioned to separate said first vacuum chamber and said second vacuum chamber; a metering needle rigidly attached to said piston and movably positioned in said first gas passageway; a spring positioned in said first vacuum chamber to apply force on said piston and bias said metering needle in a closed mode; an idle adjustment needle positioned in said second gas passageway; a connector tube for flow of gaseous fuel from said first gas passageway; and a connector tube for flow of gaseous fuel from said second gas passageway;

(d) a fuel line for flow of gaseous fuel from said gas outlet of said pressure vessel into said first gas passageway and said second gas passageway of said metering valve;

(e) a solenoid valve located in said fuel line and operated by electric energy from the electrical circuit of an automotive vehicle using the system;

(f) a magnetic reset safety switch located in the electrical circuit of an automotive vehicle using the system;

(g) a transfer valve comprised of a valve body having a first connector tube and a first inlet port for receipt of gaseous fuel from said first connector tube of said metering valve, a second connector tube and a second inlet port for receipt of gaseous fuel from said second connector tube of said metering valve, a first outlet port for discharge of gaseous fuel entering said transfer valve through said first inlet port and a second outlet port for discharge of gaseous fuel entering said transfer valve through said second inlet port; a dual action spool movably positioned in said valve body, said dual action spool having a first control position which prevents gaseous fuel from departing said transfer valve through said first outlet port while allowing gaseous fuel to depart said transfer valve through said second outlet port and a second control position which prevents gaseous fuel from departing said transfer valve through said first outlet port while allowing gaseous fuel to depart said transfer valve through said first outlet port; a valve operator operatively connected to said dual action spool; mechanical means for connecting said valve operator and the throttle linkage on the carburetor; and an adaptor for connecting said first outlet port and said second outlet port;

(h) a first flexible hose for connecting said first connector tube on said metering valve and said first connector tube on said transfer valve;

(i) a second flexible hose for connecting said second connector tube on said metering valve and said second connector tube on said transfer valve;

(j) an auxiliary fuel nozzle positioned immediately above the outlet of the main nozzle in the center of the Venturi of the carburetor; and (k) a fuel line connecting said adapter on said transfer valve and said auxiliary fuel nozzle.

* * * * *